US009637207B2

(12) United States Patent
Ostervold et al.

(10) Patent No.: US 9,637,207 B2
(45) Date of Patent: May 2, 2017

(54) TOOL AND METHOD FOR CLEANING SURFACES SUBSEA

(76) Inventors: Tor Mikal Ostervold, Bekkjarvik (NO); Sten Terje Ostervold, Bekkjarvik (NO)

( * ) Notice: Subject to any disclaimer, the term of this patent is extended or adjusted under 35 U.S.C. 154(b) by 627 days.

(21) Appl. No.: 13/575,479

(22) PCT Filed: Feb. 3, 2011

(86) PCT No.: PCT/EP2011/051521

§ 371 (c)(1),
(2), (4) Date: Aug. 29, 2012

(87) PCT Pub. No.: WO2011/095531

PCT Pub. Date: Aug. 11, 2011

(65) Prior Publication Data

US 2012/0317750 A1 Dec. 20, 2012

(30) Foreign Application Priority Data

Feb. 3, 2010 (NO) ..... 20100172

(51) Int. Cl.
*B63B 59/08* (2006.01)
*B08B 3/02* (2006.01)

(52) U.S. Cl.
CPC ..... *B63B 59/08* (2013.01); *B08B 3/024* (2013.01); *B08B 2203/0229* (2013.01)

(58) Field of Classification Search
CPC ... E04H 4/1654; E04H 4/1663; E04H 4/1636; E04H 4/1609; E04H 4/1618; B63B 59/08; B08B 3/024

(Continued)

(56) References Cited

U.S. PATENT DOCUMENTS 4,095,378 A 6/1978 Urakami
4,314,521 A * 2/1982 Lundberg ..... 114/222

(Continued)

FOREIGN PATENT DOCUMENTS

DE 2201758 A1 7/1972
DE 4221086 A1 5/1993

(Continued)

OTHER PUBLICATIONS

Lendfers, Paul, "International Search Report" for PCT/EP2011/051521 as mailed Jun. 1, 2011, 5 pages.

*Primary Examiner* — Robert Scruggs
(74) *Attorney, Agent, or Firm* — Winstead PC

(57) ABSTRACT

The invention provides a tool (4) for cleaning surfaces subsea, comprising a body having a cleaning face (11) for holding against and preferably also moving along the surface to be cleaned, the face has a shape convex or corresponding to the surface to be cleaned, and a means for distance control of the cleaning face of the body such that a gap is provided between said face and the surface (3) to be cleaned when the tool is in operation, and/or openings or channels are arranged for allowing surrounding water to flow in towards the center of the cleaning face. Further, the cleaning face comprises a suction outlet for water, debris and contamination, in operation the outlet (13) is connected to a suction device (17) so that water, debris and contamination is drawn into the outlet for transport to further treatment.

9 Claims, 6 Drawing Sheets

Figure 1:
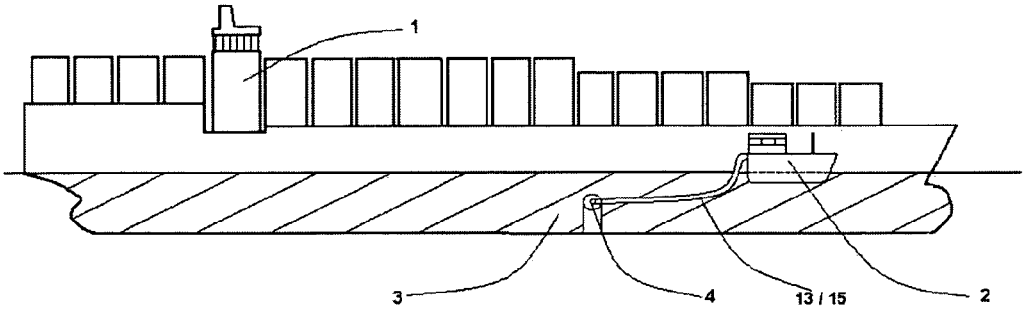

(58) Field of Classification Search
USPC ..... 15/1.7, 319, 322, 357, 382, 409, 415.1; 114/222
See application file for complete search history.

(56) References Cited

U.S. PATENT DOCUMENTS

| | | | | |
|---|---|---|---|---|
| 4,838,193 | A * | 6/1989 | van der Tak | B63B 59/08 114/222 |
| 4,926,775 | A | 5/1990 | Andorsen | |
| 4,997,052 | A | 3/1991 | Urakami | |
| 5,099,535 | A | 3/1992 | Chauvier et al. | |
| 6,896,742 | B2 * | 5/2005 | Geyer | E01H 1/103 134/21 |
| 8,327,787 | B2 * | 12/2012 | Achord | 114/222 |

FOREIGN PATENT DOCUMENTS

| | | | |
|---|---|---|---|
| DE | 202008010345 | U1 | 10/2008 |
| EP | 2022714 | A1 | 2/2009 |
| GB | 2194136 | A | 3/1988 |
| WO | WO-0208547 | A1 | 1/2002 |
| WO | WO-03/059732 | A1 | 7/2003 |
| WO | WO-2009/142506 | A1 | 11/2009 |

* cited by examiner

TOOL AND METHOD FOR CLEANING SURFACES SUBSEA

FIELD OF THE INVENTION

The present invention relates to cleaning of subsea surfaces, that is submerged or immersed surfaces. More specifically, the invention relates to tools and methods for cleaning of subsea surfaces without contaminating the surrounding water.

BACKGROUND OF THE INVENTION AND PRIOR ART

Cleaning of subsea surfaces, such as the submersed parts of ship hulls, receives gradually more attention. One reason is the advantages of cleaning hulls of vessels in order to improve fuel economy due to reduced friction when sailing. Another reason is the resulting pollution, not only from released soft and hard marine or aquatic growth, but also possibly released or scraped-off anti-fouling agents, paint and other poisonous and harmful materials. Previously, the released material used to be left in the water at the site of cleaning, resulting in pollution and sediments that easily are swirled about by large ships. Patent publication U.S. Pat. No. 4,926,775 contains description and illustration of a tool useful for cleaning of subsea surfaces, but operation of the tool results in severe pollution.

However, in patent publication WO 2009/142506, two embodiments of a cup-shaped rotating tool with spraying nozzles and a central suction outlet are described, and related methods for cleaning. In one embodiment, the cup having integrated nozzles rotates, the rotation is due to the momentum from the cleaning fluid being sprayed out from the nozzles. In the other embodiment, rotary arms with nozzles rotate inside the cup, the rotation is about the central outlet, around which outlet the plumbing of a watery cleaning fluid supply is arranged. The tools have proved to work very well, but they are quite complicated and therefore rather expensive and susceptible to malfunction. Further, the rotating mass is large, the energy for rotation is taken from the flow energy of the cleaning fluid, resulting in less energy for cleaning. And even though the suction effect of the tools in operation is good, improved suction effect is desirable, which will facilitate the operation as the tool easier will follow the surface to be cleaned.

Accordingly, a demand exists for tools that are simpler, less expensive, even more reliable and with improved cleaning effect and suction effect. The objective of the present invention is to provide tools and methods that are beneficial with respect to the above mentioned demand.

SUMMARY OF THE INVENTION

The objective is met with the present invention.

The invention provides a tool for cleaning surfaces subsea, comprising

- a body having a cleaning face for holding against and preferably also moving along the surface to be cleaned, the face has a shape convex or corresponding to the surface to be cleaned, and
- a means for distance control of the cleaning face of the body such that a gap is provided between said face and the surface to be cleaned when the tool is in operation, and/or openings or channels are arranged for allowing surrounding water to flow in towards the centre of the cleaning face. Further, the cleaning face comprises a suction outlet for water, debris and contamination, in operation the outlet is connected to a suction device so that water, debris and contamination is drawn into the outlet for transport to further treatment. More specifically, surrounding water is drawn in under the cleaning face and together with loosened material it is sucked into the suction outlet.

The tool is a far simpler construction than the existing tools described above, the simplest embodiments are without nozzles for spray of high pressure cleaning fluid or other specific means for cleaning, such as brushes, which embodiments are particularly beneficial for removal of soft marine growth and where investments must be kept at a minimum. Other embodiments are beneficial for more or all of the parameters discussed above.

The term cleaning face means surface or side of the tool to be held against the surface to be cleaned. Said face is flat or more convex than the surface to be cleaned is concave, in order to be held tightly or at a controlled gap distance from said surface. The openings or channels allows tight placement on the surface to be cleaned, but for most embodiments a gap is provided by distance means such as rollers, wheels, balls or brushes with adapted stiffness, which stiffness preferably increases stepwise or gradually toward the cleaning face. The suction outlet is preferably but not necessarily coaxial or central in or on the cleaning face. A supply line of high pressure cleaning fluid, preferably water, is preferably arranged coaxial and central for tools having cleaning nozzles that rotate, with a high pressure swivel for rotation included. Rotation of nozzles, discs and brushes are preferably achieved by momentum or flow energy from injection nozzles, by directing the nozzles inclined or obliquely inwards, inside the circumference of the cleaning face and directed at an angle from the supply pipe or an arm rotatably connected to it. Alternative means for rotation are for example based on a possible turbine in the suction flow, the turbine hydraulically or mechanically driving the rotatable parts, or a motor. Nozzles can be arranged to rotate on a rotatable disc. The cleaning face preferably comprises flat surface inside the periphery, preferably circular symmetric, such as a flat ring shape. In operation the flat surface provides underpressure and suction effect of the tool toward the surface according to the venturi effect, due to low static pressure in the flow. In operation, the suction flow must be larger than the possible high pressure injection jet flow, in order to maintain suction effect of the tool. Preferably the suction flow rate is 1.5 times or more than the jet flow rate. Due to the flat surface, providing improved suction effect, the ratio suction flow rate/jet flow rate can be lower than for related prior art tools.

Preferably, the flat ring shaped surface inside the periphery is larger than the edge of the cup according to WO 2009/142506, that is wider than 2 mm, 5 mm, 8 mm, 10 mm, 15 mm, 20 mm, 25 mm, 30 mm, 40 mm or 50 mm. Said ring shaped surface is preferably without any disturbing jet flows/cleaning nozzles, so that the holding effect of said ring shaped surface is not disturbed and a maximum of cleaning effect and ease of moving is maintained. Cleaning nozzles are preferably arranged only inside said flat ring shaped surface in order not to disturb the holding effect of said flat ring shaped surface, and preferably nozzles are not directed so as to disturb the in substance laminar flow under said flat surface. These feature, each one alone but more preferably in combination, provide a surprising effect of good cleaning capability and ease of manipulating the tool.

The tool of the invention may include any feature as described or illustrated here or elsewhere, in any operative combination, said combinations are all embodiments of the invention.

The invention also provides a method for cleaning surfaces subsea, using a tool according to the invention, distinguished by the steps:

holding a cleaning face of the tool against the surface to be cleaned, and activate suction flow through a suction outlet in the cleaning face, activate an optional spray of high pressure cleaning fluid through optional high pressure cleaning nozzles, and moving the cleaning face of the tool to cover the surface to be cleaned.

Either a diver, a ROV (remotely operated vehicle) or a ROT (remotely operated tool) hold and manipulates the tool, by replacements or moving along the surface to be cleaned. To this end, the tool comprises a convenient handle or fastening.

The invention also provides use of the tool according to the invention, for cleaning surfaces subsea whilst collecting loosened debris and other material for further treatment.

A further embodiment of the invention is a method for verification of the quality, such as the paint quality of a surface, distinguished by cleaning the surface by operating a tool of the present invention, collecting the loosened material, analyzing said material in order to find out whether or not paint or corrosion products etc. are included in a significant quantity. If for example paint is loosened and thereby included in the collected material, the quality of the paint is insufficient. The quality of the paint can be measured as a function of the amount of paint in the collected material. The tool and operating conditions are preferably standardized, but can be adapted specifically to specific surfaces.

FIGURES

The invention is illustrated with figures, of which

FIG. 1 illustrates a method of using a tool, according to the present invention, and FIGS. 2-7 illustrate example embodiments of a tool according to the present invention.

DETAILED DESCRIPTION

Reference is made to FIG. 1, illustrating an example of a cleaning operation of the invention. Visualised is a cargo vessel 1 at port, with a service vessel 2, undertaking cleaning to the submerged surfaces of cargo vessel 1, 3. The cleaning tool 4 is held by or assembled with a remotely operable vehicle (ROV) 5, which is manoeuvred from the service vessel 2. The cleaning tool is manipulated to cover said surface with a cleaning face of the tool whilst said surface is cleaned. All loosened debris and other material are filtrated and hard waste collected when its comes onboard the service vessel 2. Filtration, UV-radiation and separation and collection of any poisonous material are some of the operations that can take place on the service vessel 2. In order not to overload the drawing with information, the ROV and the connection to it are not illustrated. An upper horizontal line indicates sea level in the drawings.

Figure 2:
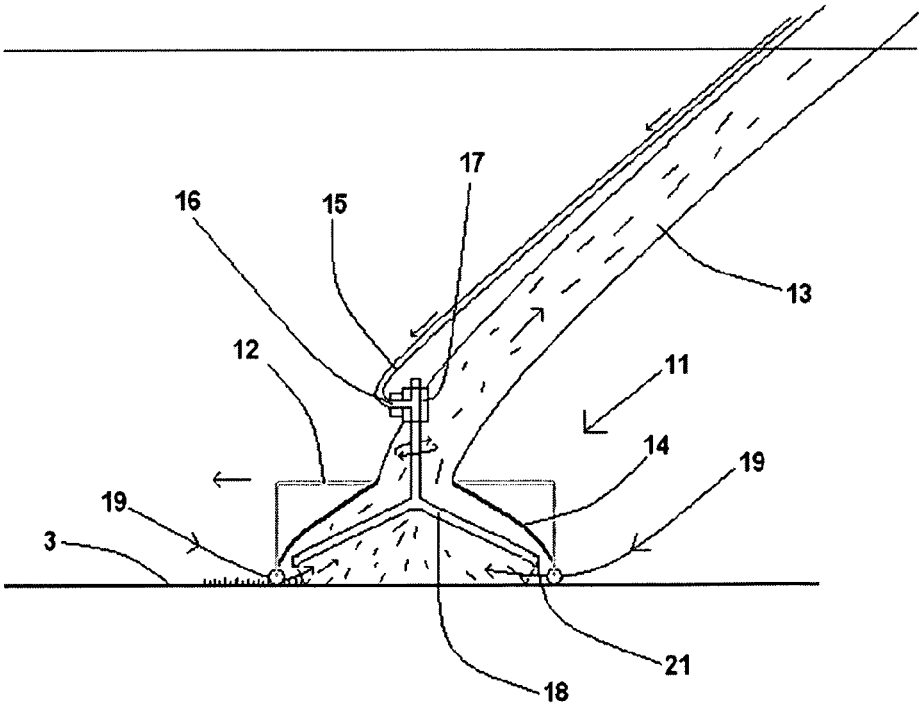

FIG. 2. illustrates a cleaning tool comprising a cleaning face 11, a spacer frame 12, a vacuum hose 13, a suction nozzle 14, a high pressure hose 15, a high pressure inlet 16, a high pressure low diameter swivel 17, rotatable high pressure pipes 18 and high pressure nozzles 21. The figure illustrates, by arrows, how the cleaning tool operates, as the rotating fluid arms 18 are cleaning the surface 3 whilst dirt is sucked into the suction chamber 14 from where it is transported throughout the vacuum hose 13 to the service vessel 2 for further treatment. From outside of the tool, water 19 is sucked into the suction chamber and further throughout the vacuum hose. High pressure cleaning fluid, i.e. water, comes from a high pressure pump onboard the service vessel, through the high pressure hose 15, further into a water inlet 16 and through the high pressure swivel 17 before flowing into the high pressure arms 18 having spray nozzles in its external ends 21. The inward and inclined orientation of the jet nozzles 21 causes the rotation of the high-pressure pipes 18, due to forces from the jet flow. Preferably the means for distance control is integrated as wheels or roller balls or similar on or into the cleaning face, not as a separate spacer frame 12 as illustrated as an example.

Figure 3:
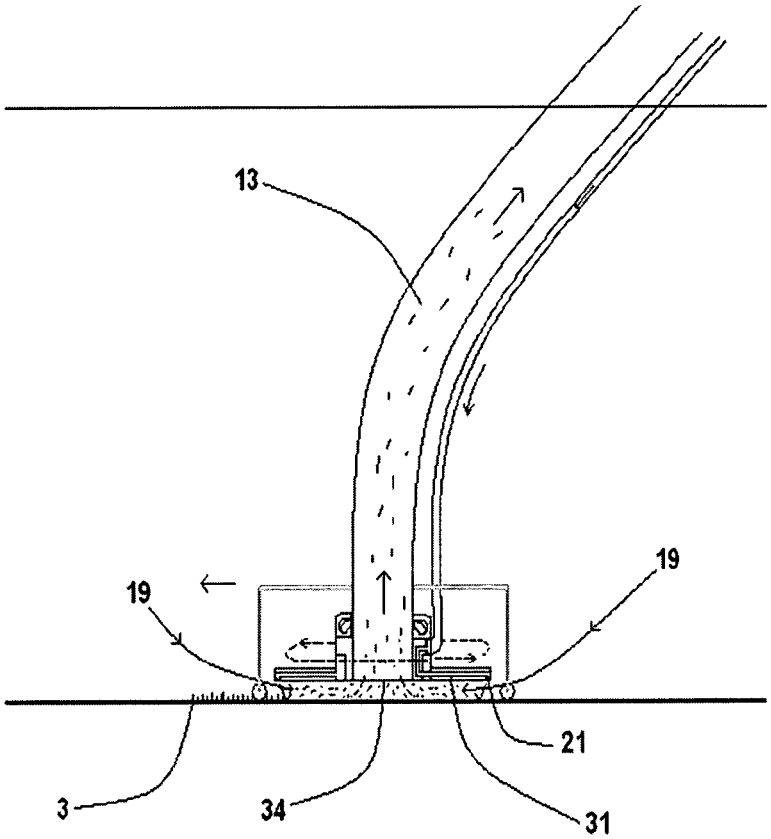

FIG. 3 illustrates a tool with a cleaning face comprising a rotating disc 31 mounted at the lower rim of a suction hose 13. All released debris is flushed from the high pressure nozzles 21 in an angle towards the centre of the disc 34, where it is sucked through the vacuum hose 13 to the assisting vessel 2 for further treatment. The angle of the jet nozzles 21 causes the disc 31 to rotate in addition to cleaning the submerged surface 3. The high pressure line for jetting cleaning fluid is preferably arranged in the suction line, with a central swivel. The rotatable disc may include brushes on the cleaning face, preferably exchangeable brushes, so that harder brushes can be used for removing scale or other hard materials.

Figure 4:
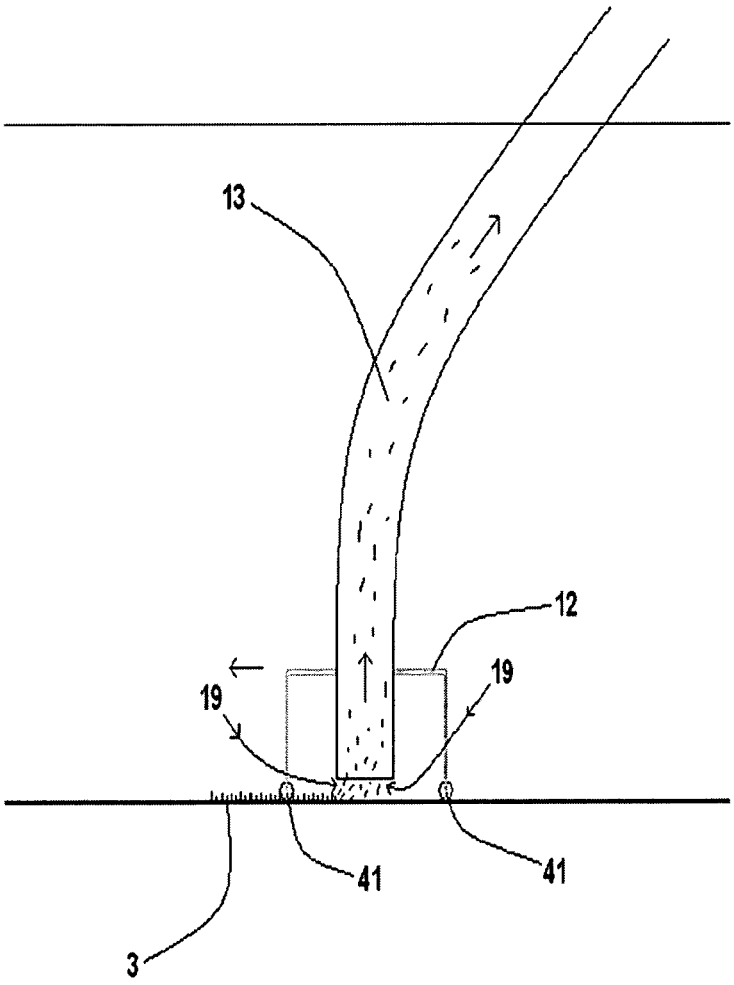

FIG. 4. illustrates a basic embodiment of the tool of the invention, as it contains only a spacer frame 12 with wheels 41 and a suction hose 13. The tool is manipulated over an impure surface and debris is sucked up and transported through the suction hose for further treatment in the assisting vessel. This embodiment is sufficiently effective for removal of soft marine growth from ship hulls, concrete structures and other submerged surfaces.

Figure 5:
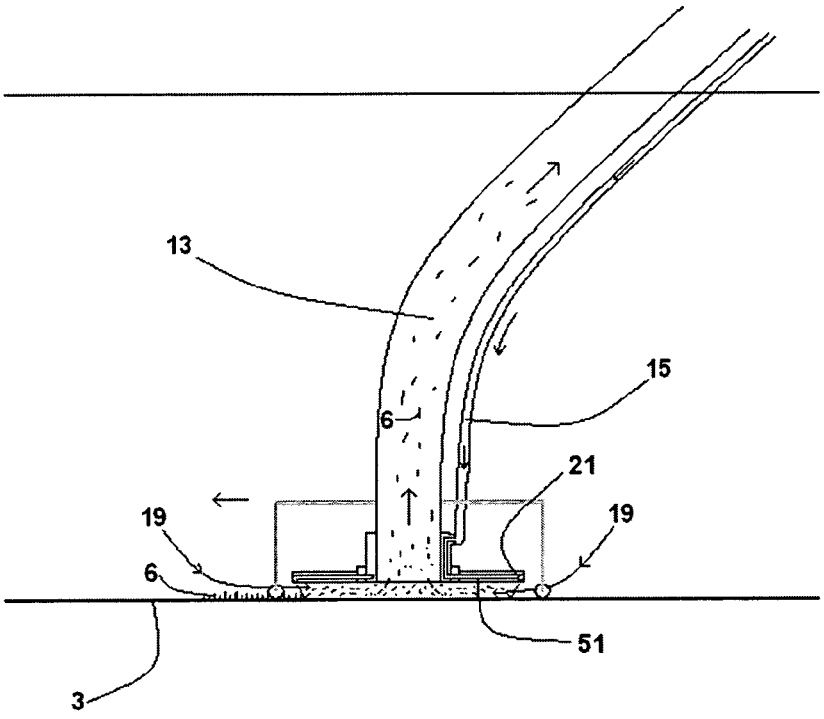

FIG. 5. illustrates a tool with a disc 51 which include drilled holes enabling an even water transfer from the high pressure hose 15 to nozzles 21 mounted in the discs 51. The range of nozzles enables provides evenly cleaning of the surface 3. Released debris and other material 6 is transported, through the suction hose 13, to the service vessel 3 for further treatment.

Figure 6:
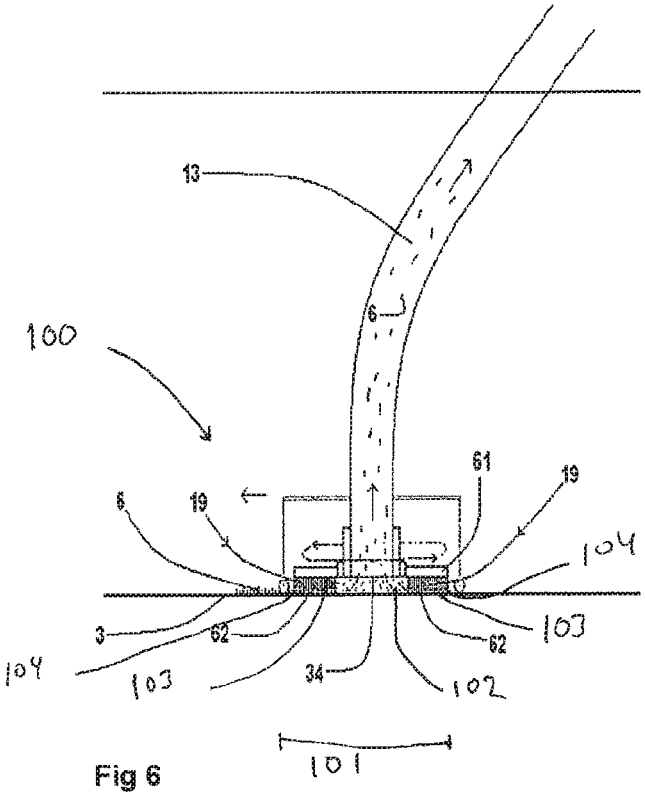

FIG. 6. illustrates a tool 100 having a rotating disc 61 with brushes 62 at its underside, the cleaning face 101 includes a flat region 103 that extends from a peripheral edge 104 to an inner region 102. The rotating disc with brushes is moved over the surface 3 to remove all unwanted materials 6 from the surface, which materials are then sucked up into the central opening of the disc 34 and further through the suction hose 13. Means for distance control are preferably included, such as integrated into the brushes by adapted stiffness and roller wheels or roller balls, as illustrated, in order to avoid jamming of the tool. Sliding of the tool 100 along the 5 surface is surprisingly easy as the friction is surprisingly low while the disc rotates and the suction effect by the venturi effect is surprisingly good. Also the cleaning is surprisingly good. Preferably, rotation is achieved by a turbine in the suction line, operatively connected to the disc. Preferably, the suction line inlet of the tools of the invention comprises a seat for a turbine, such as on a shaft 10 connected to a rotating disc and/or nozzles.

Figure 7:
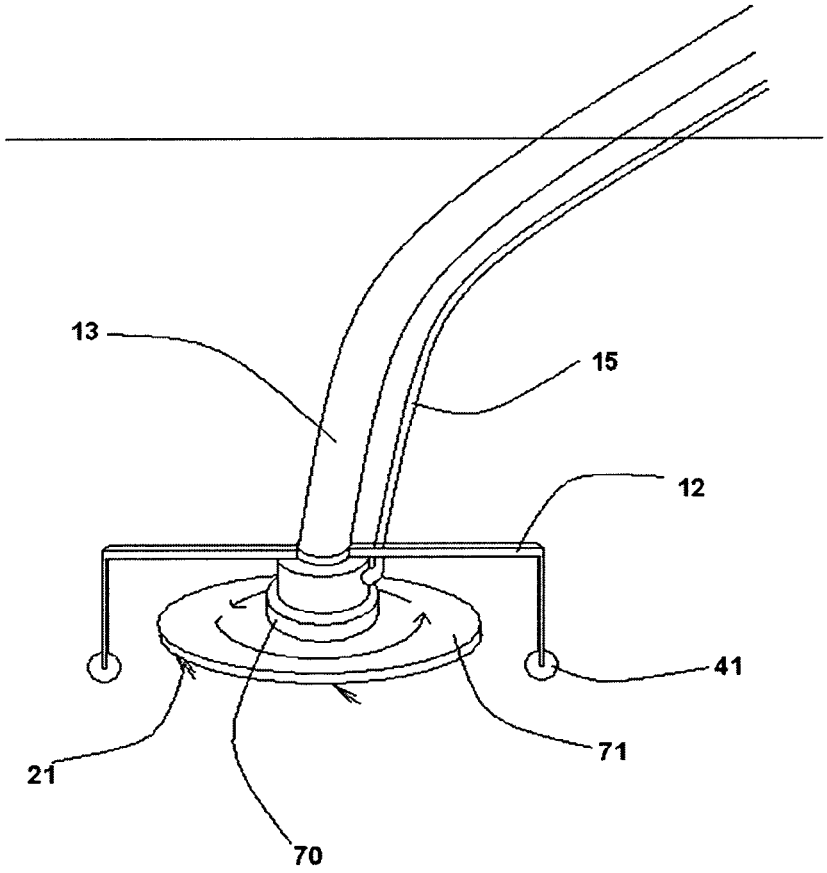

FIG. 7. illustrates a tool having a rotating disc 71 which is driven by a turbine/motor 70. This enables the disc/plate to rotate in either direction, as its cleaning jets are not the means for rotation. At the underside of the disc a number of nozzles 21 are integrated, the nozzles flushes the surface 3 with high-pressurised water. Likewise the other figures, all loosened fouling/material 6 is removed from the submerged surface, by the high-pressurised water jets and sucked into the suction in the middle 34 of the disc 71. From there on, the fouling is sucked through the suction hose 13 for further treatment onboard the assisting vessel 2. The great advantage of this solution is that the cleaning is more efficient as the jets do not loose energy on rotating the disc, rather all nozzle energy is used for cleaning. Subsequently, less cleaning pressure and flow is needed and it is possible to control the discs rotation by controlling the motor/turbine that drifts the disc. The turbine and rotating disc are preferably arranged to a common central shaft.

The tool, methods and use of the invention may comprise any operative combination of features as described or illustrated in this document, which combinations are embodiments of the invention.

The invention claimed is:

1. A tool for cleaning subsea surfaces, the tool, comprising:

a body having a cleaning face for holding against and moving along a surface to be cleaned, the cleaning face comprising an inner region having a shape convex or corresponding to the surface to be cleaned and a flat region having a flat surface, the flat region extending from the inner region to a peripheral edge of the cleaning face, the flat region having a ring shape with a radial width of at least 10 mm;

a means for distance control of the cleaning face of the body such that a gap is provided between said flat surface of the flat region of the cleaning face and the surface to be cleaned when the tool is in operation;

at least one of cleaning nozzles and brushes arranged in the inner region;

a suction outlet for water, debris, and contamination inside the inner region, the suction outlet being arranged in the inner region and being connected to a suction device so that water, debris, and contamination is drawn into the suction outlet for transport to further treatment;

wherein the suction outlet creates underpressure in the inner region during operation; and wherein the flat surface provides enhanced underpressure and suction effect of the tool towards the surface according to a venturi effect, by water flowing from outside the tool to the inner region without increasing friction.

2. The tool according to claim 1, wherein the flat region has a width of at least 20 mm.

3. The tool according to claim 1, wherein the inner region includes a central chamber, a cleaning fluid supply line is arranged at the centre of the chamber and the cleaning face, rotatable about a swivel, arms extend in radial direction from the cleaning fluid supply line, cleaning nozzles are arranged on the arms, directed inclined at an angle inwards at the surface to be cleaned, inside the chamber.

4. The tool according to claim 1, wherein the means for distance control comprises roller balls on a flat ring-shaped surface inside the periphery of the tool.

5. The tool according to claim 1, comprising cleaning brushes arranged on the cleaning face, such as on a flat ring-shaped rotatable or non-rotatable surface inside the periphery of the tool, the brushes may act as the means for distance control in addition to providing mechanical or abrasive cleaning effect.

6. The tool according to claim 1, wherein the cleaning face comprises a disc-shaped surface (disc), the disc includes holes that at inner ends are connected to a high pressure cleaning fluid supply and at outer ends are shaped and directed as high pressure nozzles disposed within the flat region of the cleaning face and directed at the surface to be cleaned.

7. A method for cleaning subsea surfaces using a tool according to claim 1, the method comprising:

holding a cleaning face of the tool against the surface to be cleaned, and activate suction flow through a suction outlet in the cleaning face;

activate at least one of a spray of high pressure cleaning fluid through high pressure cleaning nozzles and cleaning brushes; and moving the cleaning face of the tool to cover the surface to be cleaned.

8. The method according to claim 7, comprising operating the tool subsea whilst collecting loosened debris and other material for further treatment or analysis.

9. A method for verification of a quality on a surface, the method comprising:

cleaning the surface by operating a tool, the tool comprising a flat surface inside a periphery of a cleaning face, the flat surface having a width of at least 10 mm, wherein the flat surface enhances underpressure and suction effect of the tool toward the surface according to a venturi effect, without increasing friction;

collecting loosened material;

analyzing said loosened material in order to find out whether or not paint or corrosion products are included in a significant quantity; and quantifying said quantity.

* * * * *